US007448902B1

(12) United States Patent
Irwin et al.

(10) Patent No.: US 7,448,902 B1
(45) Date of Patent: Nov. 11, 2008

(54) MECHANICAL DEVICE SHOWING PRIOR MATING

(75) Inventors: William David Irwin, Elizabethtown, PA (US); Keith Edwin Miller, Manheim, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 12/109,662

(22) Filed: Apr. 25, 2008

(51) Int. Cl.
*H01R 29/00* (2006.01)

(52) U.S. Cl. ..... 439/489; 439/510

(58) Field of Classification Search ..... 439/188, 439/489, 510; 200/51.12
See application file for complete search history.

(56) References Cited

U.S. PATENT DOCUMENTS

| | | | | |
|---|---|---|---|---|
| 5,509,823 | A | 4/1996 | Harting | |
| 5,713,760 | A * | 2/1998 | Chemin | 439/595 |
| 5,749,753 | A * | 5/1998 | Chishima et al. | 439/752.5 |
| 5,967,817 | A | 10/1999 | Greenstein | |
| 5,997,343 | A | 12/1999 | Mills | |
| 6,048,218 | A | 4/2000 | Greenstein | |
| 6,165,005 | A | 12/2000 | Mills et al. | |
| 6,234,816 | B1 | 5/2001 | Greenstein | |
| 6,244,882 | B1 | 6/2001 | Greenstein | |
| 6,259,170 | B1 | 7/2001 | Limoge | |
| 6,280,213 | B1 | 8/2001 | Tobler | |
| 6,319,031 | B1 | 11/2001 | Greenstein | |
| 6,346,014 | B1 | 2/2002 | Griesser | |
| 6,524,133 | B2 * | 2/2003 | Murakami | 439/595 |
| 6,638,109 | B2 * | 10/2003 | Kurimoto et al. | 439/595 |
| 6,714,809 | B2 | 3/2004 | Lee | |
| 7,077,684 | B2 | 7/2006 | Sasame | |
| 7,131,860 | B2 | 11/2006 | Sartor | |
| 7,247,046 | B1 | 7/2007 | Wu | |

* cited by examiner

*Primary Examiner*—Neil Abrams
*Assistant Examiner*—Phuong Nguyen

(57) ABSTRACT

A mechanical device that indicates prior mating. The device comprises a first part having a first conductive device movable from a first position to a second position and a plurality of second conductive devices, and a second mating part including a plurality of third conductive devices mateable to the plurality of second conductive devices. On initial mating of the first and second part, the second part causes the movable first conductive device to move from the first position to a second position where it is captured, while closing a circuit that causes a signal to be sent. Further mating of the first and second parts connects the plurality of second conductive devices to the plurality of third conductive devices. In subsequent unmating and remating of the first and second parts, the first conductive device, being captured in its second position, does not result in a circuit closing before the plurality of second conductive devices mate with the third conductive devices. Either no signal is generated or the signal is ignored since the timing of the closing of the circuit is not prior to the mating of the plurality of second conductive devices with the third conductive devices.

19 Claims, 7 Drawing Sheets

MECHANICAL DEVICE SHOWING PRIOR MATING

FIELD OF THE INVENTION

The present invention is directed to a mechanical device that indicates prior mating between two assembled parts.

BACKGROUND OF THE INVENTION

Many parts are designed to be mated and unmated. However, in certain circumstances, it is not desirable to repeatedly mate one part to another. There are various reasons why such repeated mating and mating is undesirable. One reason may be that one of the parts may be designed for a limited number of matings or unmatings, after which further mating and unmating is no longer reliable. Another reason is that one of the mating parts may be further connected to an item such as instrumentation that is to be disposed of after a single use or limited number of uses. In this circumstance, it is desirable to prevent multiple uses of the instrumentation or uses beyond the limited number of uses. Currently, there are no reliable part designs to assure that the parts that are to be mated are not used beyond their design life. The current limitations rely upon the individual performing the mating functions to dispose of the part at the end of its intended life.

What is needed is a device that reliably prevents the repeated mating and unmating of parts beyond their intended cycle life for mating and unmating. It is desirable that such a device be inexpensive that it can be used with instrumentation providing additional assurances that a user does not utilize such instrumentation beyond its recommended life. The device should provide some safeguards with regard to reuse of the instrumentation. If possible, it should automatically preclude reuse of instrumentation that has become obsolete because its limited number of uses has been exceeded.

SUMMARY OF THE INVENTION

The present invention is mechanical device that indicates prior mating. The device comprises a first part having a first conductive device movable from a first position to a second position and a plurality of second conductive devices, and a second mating part including a plurality of third conductive devices. On initial mating of the first and second part, the second part causes the movable conductive device to move from the first position to a second position where it is captured, while closing a circuit that causes a signal to be sent. Further mating of the first and second parts connects the plurality of second conductive devices to the plurality of third conductive devices. In subsequent unmating and remating of the first and second parts, the first conductive device, being captured in its second position, does not result in a circuit closing before the plurality of second conductive devices mate with the third conductive devices. Either no signal is generated or the signal is ignored since the timing of the closing of the circuit is not prior to the mating of the plurality of second conductive devices with the third conductive devices.

In its broadest embodiment, the present invention is a mechanical device showing prior mating. The device comprises a first part which includes a first conductive device movable from a first position to a second position, a retention feature for capturing the movable conductive device in the second position, and a plurality of second conductive devices. It also includes a second part which includes a plurality of third conductive devices mateable with the second conductive devices and a plurality of fourth substantially inelastic conductive devices. The second part is mateable to the first part. Upon initial mating, the fourth substantially inelastic conductive devices of the second part contact the first movable conductive device of the first part to close a circuit prior to the plurality of second conductive devices of the first part contacting the plurality of third conductive devices of the second part. Closing of the circuit between the fourth substantially inelastic conductive devices and the first movable conductive device results in a signal being generated. Upon full mating of the first and second parts, the fourth substantially inelastic conductive devices of the second part urge the movable first conductive device of the first part to its second position, at which location it is captured by the retention feature, the second position being such that upon any subsequent mating of the first and second part, the plurality of second conductive devices of the first part contact the plurality of third conductive devices of the second part prior to the first movable conductive device of the first part contacting the fourth substantially inelastic conductive devices of the second part.

The mechanical device is effective when used with equipment that can detect and react to the signals generated during initial mating, when the fourth substantially inelastic conductive devices of the second part contact the first movable conductive device of the first part. The equipment may also react to any signal generated when the plurality of second conductive devices of the first part mate with the third conductive devices of the second part. However, this is not a requirement, as the mechanical device may be provided with electronics integral to the device that reacts to the signals to track mating and unmating by responding in some fashion to the generated signals.

An advantage of the present invention is that the mechanical device that indicates prior mating can provide an effective way to avoid a reuse of instrumentation with equipment beyond a predetermined number of uses. The mechanical device that indicates prior mating can be provided for single use or a limited number of uses and can be made inexpensively, connected to the instrumentation, and then disposed of with the disposable instrumentation, if so desired.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

Whenever possible, the same reference numbers will be used throughout the figures to refer to the same parts performing the same function.

DETAILED DESCRIPTION OF THE INVENTION

Figure 1:
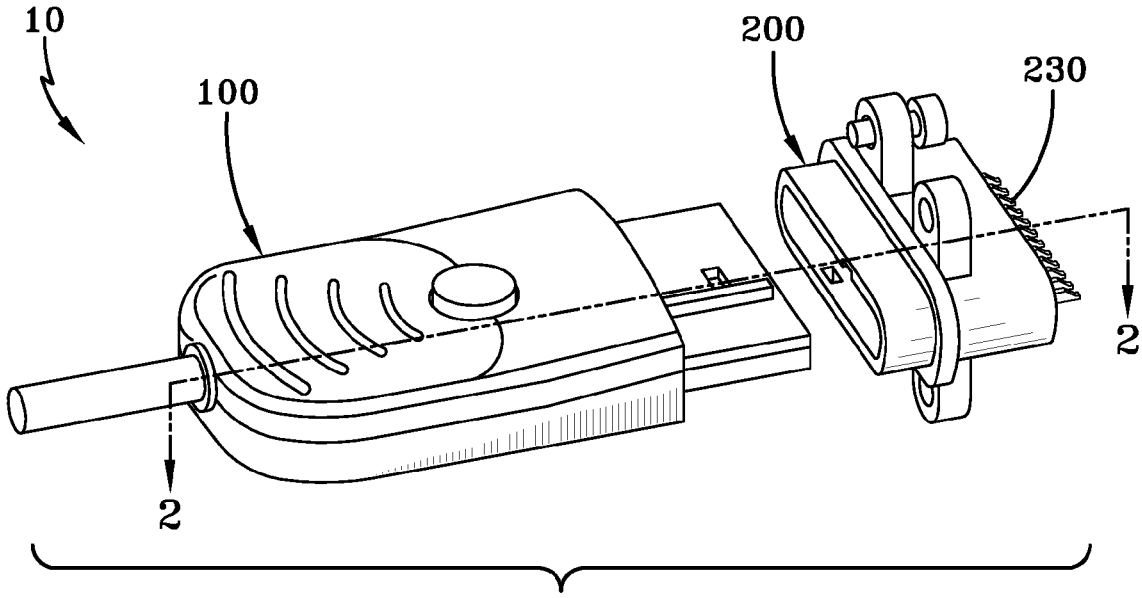
FIG. 1 depicts a top perspective view of a plug connector and a receptacle of the present invention in an unmated condition.

A mechanical device that shows prior mating includes a first part mateable to a second part. In one embodiment, the first part may be a plug connector that includes a plurality of second conductive devices that are metal contacts. Each metal contact is configured to accept a wire. The plug connector further includes a housing to locate and align the plurality of metal contacts. The housing includes an exterior and an interior. The movable conductive device preferably is a jumper contact movable from a first position to a second position within the housing.

The movable first conductive device is captured by a retention feature in the second position. Any retention feature may be used to capture the first conductive device. This may include a surface having dimensional tolerances that interfere with the jumper contact, thereby capturing the jumper contact in the second position. Alternatively, the retention feature may be a depression in the housing sized to accept movable first conductive device when the first conductive device is moved to a second position. In another embodiment, the retention feature may include a movable first conductive device having a dimple and a raised block having a nipple that engages the dimple when the movable conductive device is moved to the second position, thereby capturing the movable first conductive device in the second position, and preventing movement from its second position. In a preferred embodiment, the retention feature for capturing the movable first conductive device includes a movable first conductive device having a dimple, and a housing having a recess that engages the dimple when the movable first conductive device is moved to the second position, thereby capturing the movable first conductive device in the second position. This recess may be an aperture in the housing. In another preferred embodiment, the retention feature includes a first conductive device movable in a channel from a first position to a second position, the first conductive device further including o-rings that contact the channel. Friction existing between regions of contact between the channel and the o-rings prevent movement of the first conductive device when no force is applied to it. Thus, after the movable first conductive device is moved to its second position by application of force from the plurality of first substantially inelastic conductive devices, the o-ring friction with the channel prevents subsequent movement once this force is removed.

Alternatively, in another embodiment, the first part of the mechanical device may be a receptacle and the second part of the mechanical device may be a plug connector. The design of the contacts or of the geometry of the plug and receptacle themselves are not critical aspects of the invention. The connection between these conductive devices results in the closing of a circuit or circuits. Any reliable arrangement that accomplishes the connection to close the circuits may be utilized, and any effective arrangement, whether currently known to those skilled in the art or which may be subsequently developed may be utilized.

The present invention is further understood by reference to the following examples, which are illustrative of the above described concepts.

Figure 2:
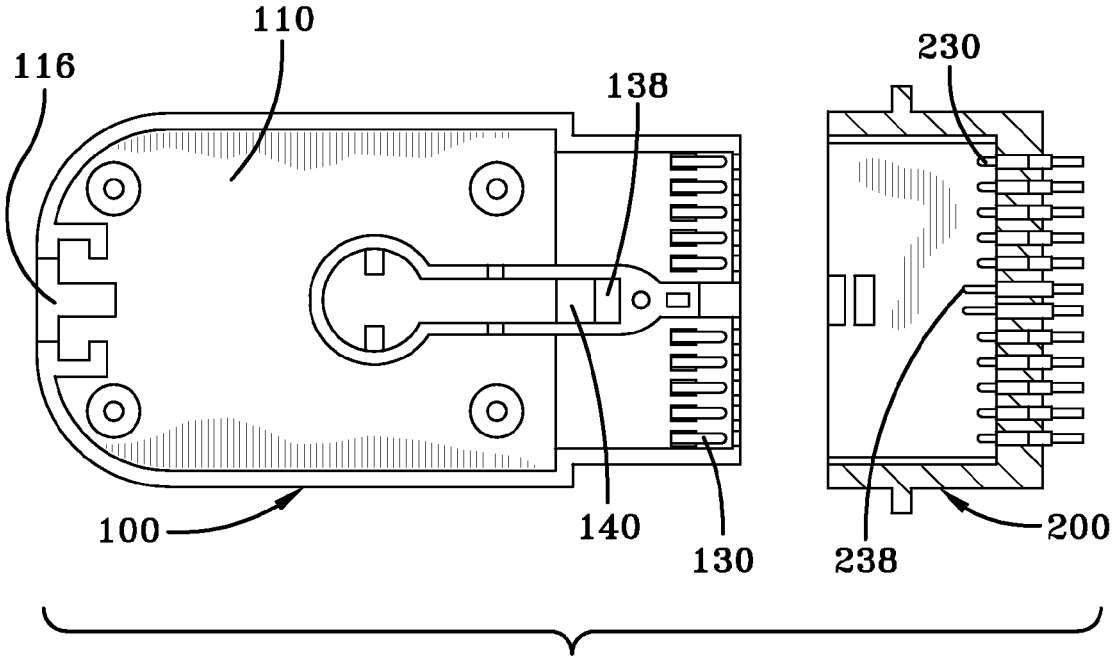
FIG. 2 depicts a plan view with the top cover of the plug connector removed and includes the receptacle of FIG. 1 along view 2-2.

A first embodiment of the present invention and its operation is depicted in FIGS. 1-4. FIG. 1 delineates a plug connector/receptacle assembly 10 of the present invention in its unmated condition. FIG. 2 depicts a cross-section of the unmated assembly 10 along cross-section 2-2. The plug connector 100 includes a plurality of metal contacts 130 positioned within a housing 110. The plug connector 100 also includes a jumper contact 138 positioned within housing 110 and adjacent to metal contacts. Although shown as in the middle of the metal contacts 130, the jumper contact 138 is not limited to this position. As plug connector 100 of FIG. 2 has never been inserted into a receptacle, jumper contact 138 is in its first position.

Also shown is receptacle 200 that interfaces with plug connector 100. Receptacle 200 includes a plurality of second contacts 230, illustrated in this example as spring probes 230, that are opposed to metal contacts 130 of plug connector 100. Spring probes, illustrated in FIGS. 1-4 are one type of contact that may be used, and any other type of contact that mates with the contacts of the plug connector may be used. The spring probes 230 have first ends that are opposed to first ends of metal contacts 130 of plug connector 100 in FIG. 2, and spring probes 230 and metal contacts 130 each have second opposite ends to receive a wire. Receptacle 200 also includes a pair of fixed contacts 238 having first ends that are opposed to jumper contact 138, fixed contacts 238 also having second opposite ends to receive a wire.

Figure 3:
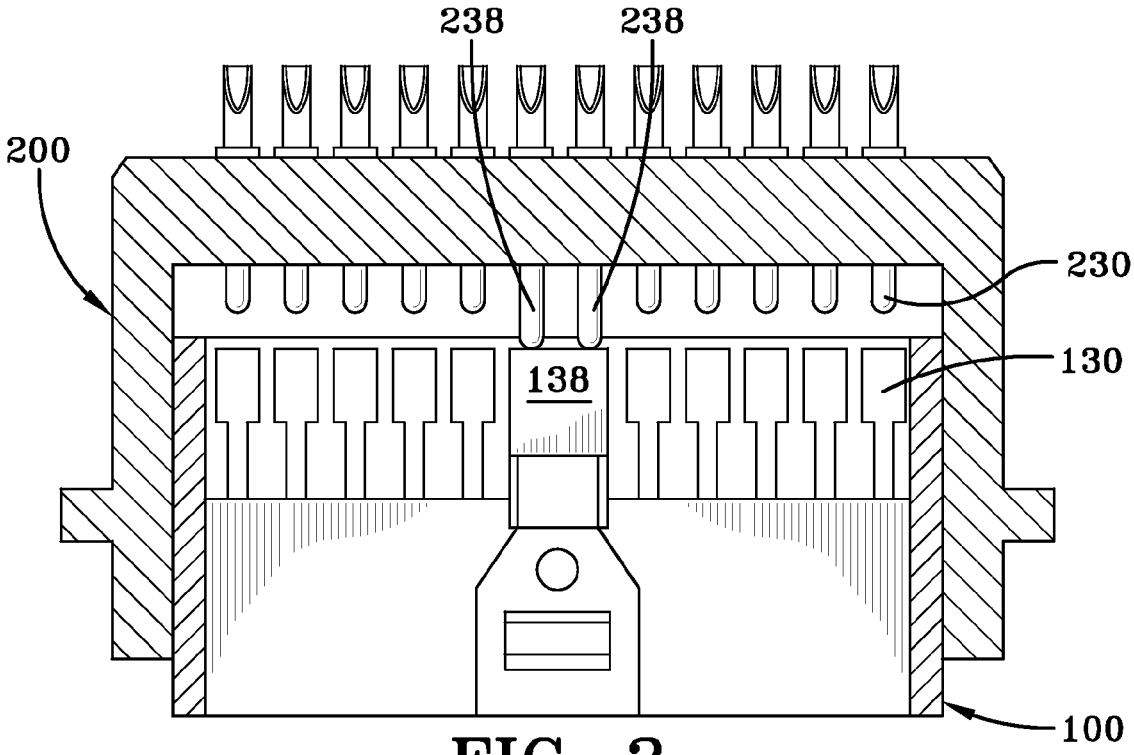
FIG. 3 depicts, in cross-section the interfacing portions of the partially mated plug connector into the receptacle, with the jumper contact and fixed metal contacts initially engaged.

FIG. 3 depicts, in cross-section, the partial mating of the interfacing portions of plug connector 100 into receptacle 200. As is evident in FIG. 3, fixed contacts 238 are just engaging jumper contact 138, but the plurality of contacts 130 are not yet in contact with the plurality of spring probes 230. The connection of fixed metal contacts 238 to jumper contact 138 coupled with the lack of contact between the plurality of metal contacts 130 and the plurality of spring probes 230 closes a circuit resulting in a signal being sent to the equipment that is connected to receptacle 200, indicating that plug connector 100 is new, or alternatively, has not previously been inserted into a receptacle.

Figure 4:
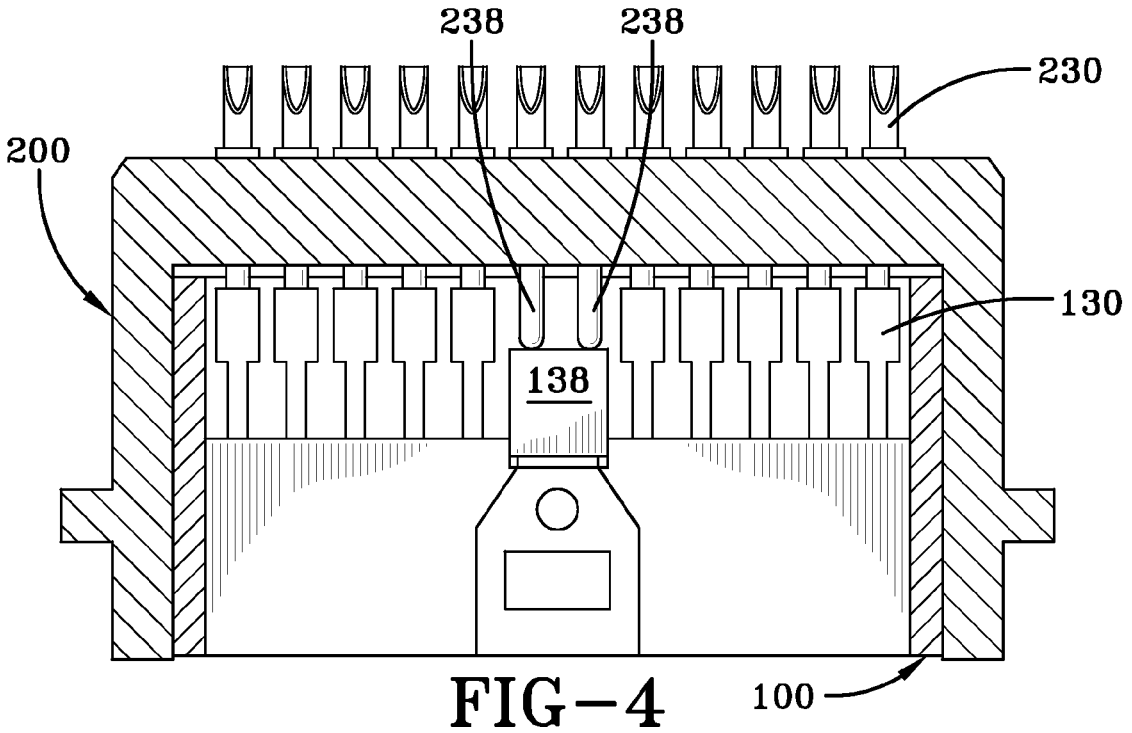
FIG. 4 depicts in cross-section the interfacing portions of the partially mated plug connector into the receptacle, with the jumper contact in its second position.

FIG. 4 depicts, in cross-section, the full mating of the interfacing portions of plug connector 100 into receptacle 200. As is evident in FIG. 4, fixed contacts 238 have fully engaged jumper contact 138 and urged it into its second position, and the plurality of metal contacts 130 have fully engaged plurality of spring probes 230, allowing instrumentation connected to plug connector 100 to operate and communicate with equipment connected to receptacle 200.

Upon movement into its second position, jumper contact 138 is captured in housing 110 and prevented from movement. As noted, jumper contact 138 is movable from a first position to a second position. As shown in FIGS. 2-3, jumper contact is in its first position. Within housing 110 of plug connector 100 is a feature that is identified as a retention feature 140, located at the second position of jumper contact 138. This retention feature may be any mechanism or feature that prevents movement of jumper contact 138 once it is moved to its second position. As plug connector 100 is further inserted into receptacle 200, fixed contacts 238, which extends further toward plug connector 100, initially contacts jumper contact 138, depicted in FIG. 3, which closes a circuit, thereby causing a signal to be sent. This signal, received before the plurality of metal contacts 130 contact plurality of spring probes 230, is interpreted by appropriate algorithms or software to indicate that the plug connector is new. Continued movement of plug connector 100 into receptacle 200 further moves jumper contact 138 to its second position, depicted in FIG. 4 into alignment with retention feature 140, where it is captured so that it can no longer return to its initial or first position.

FIGS. 2-4 also illustrate a mechanism that guides jumper contact as it moves from its first position into its second position. This is evident in FIG. 2. FIG. 3 indicates that this guide mechanism is a raised surface molded into housing 110, and jumper contact is forced over this raised surface so that its movements from a first position to a second position is guided by the raised surface. In this embodiment, jumper contact 138 can be provided with a dimple and a recess can be provided along the surface to capture jumper contact in its second position.

Figure 5A:
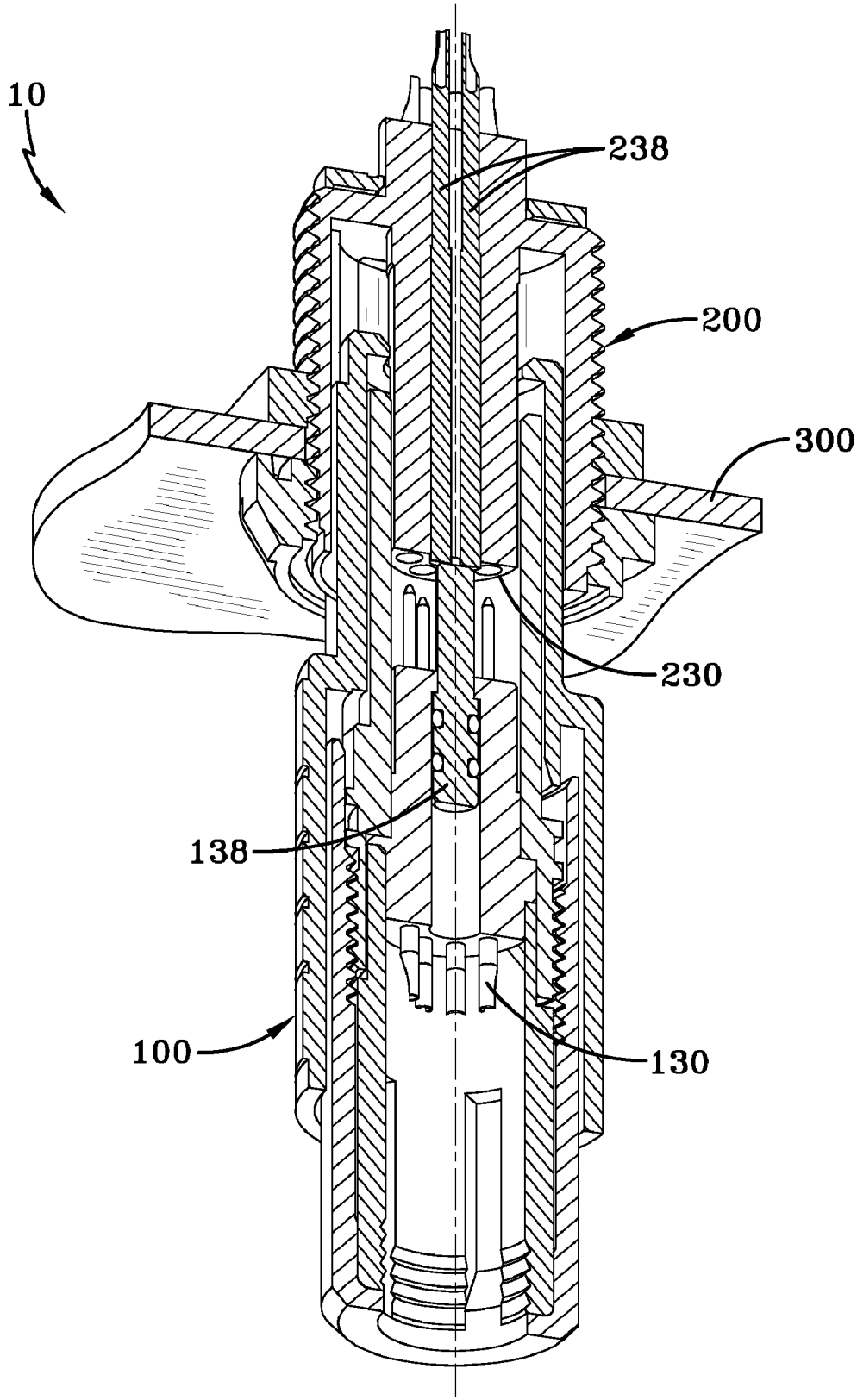
FIG. 5A depicts, in cross-section, an embodiment of a plug connector/receptacle of the present invention having a circular cross-section in a partially mated condition.

FIGS. 5 A-C illustrate a second embodiment of the present invention in which the assembly 10 has a substantially circular form. FIG. 5A depicts, in cross-section, an embodiment of the assembly 10 of the present invention having a circular cross-section in a partially mated condition. Plug connector 100 is depicted as partially mated to receptacle 200. In this embodiment, receptacle 200 is assembled to panel 300 and secured thereto. In FIG. 5A, jumper contact 138 is shown in its first position, and fixed contacts 238 are shown abutting and in contact with jumper contact 138, while a plurality of second metal contacts 130 are out of contact with a plurality of third contacts 230. First jumper contact further includes a set of o-rings, and is movable within a channel in plug connector housing. In this position, when receptacle 200 is connected to equipment and plug connector 100 is connected to instrumentation, the circuit formed by jumper contact 138 and fixed contacts 238 is closed, while the circuits formed by the second metal contacts and third metal contacts are open, resulting in a signal being transmitted to the equipment indicative of a plug connector that has not previously been mated with a receptacle. Further insertion of plug connector 100 into receptacle 200 will result in jumper contact 138 being moved from its first position to its second position, while being locked into its second position by friction between the o-rings and the housing channel, and second metal contacts 130 will engage third metal contacts 230 thereby closing these circuits and making instrumentation attached to plug connector 100 operational with the equipment, as discussed in the previous example.

Figure 5B:
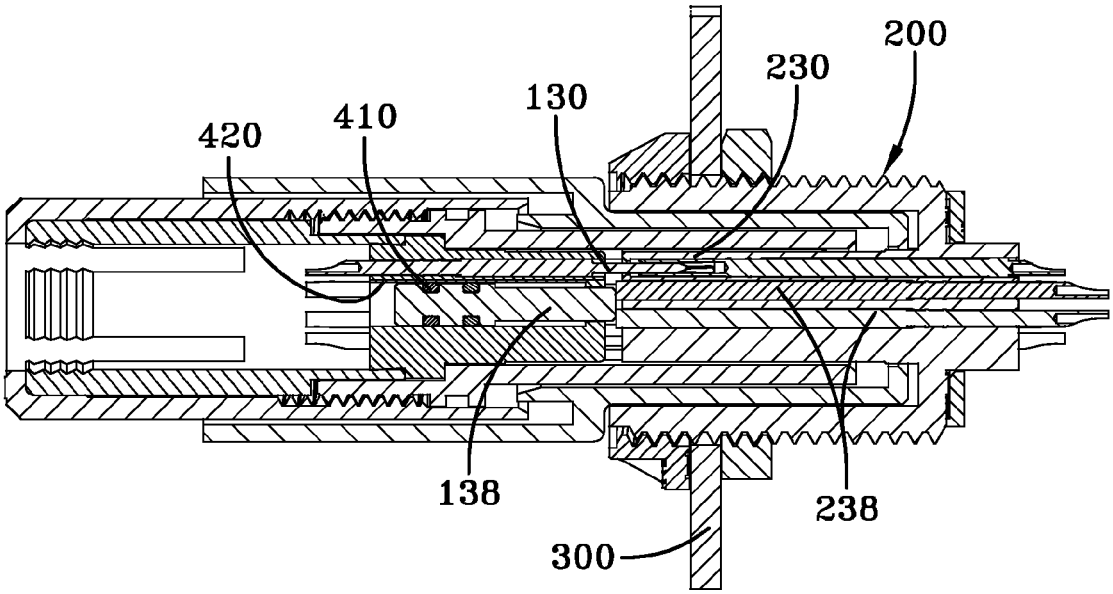
FIG. 5B is a detailed cross sectional view of section A-A of end view of the assembly of the present invention, with plug connector mated to the receptacle and the jumper contact in its second position, the fixed metal contacts in contact with the jumper contact.

FIG. 5B depicts jumper contact 138 having been moved to its second position, but still in contact with fixed metal contacts 238. Jumper contact 138, positioned in channel 420 of housing 110 is urged into its second position by fixed metal contacts 238. As can be seen in this embodiment, jumper contact 138 has included a pair of o-rings 410. O-rings may be sized to fit over jumper contact by any convenient method. For example, the jumper contact may include a recess to house the o-rings, as is known. However, the o-rings are sized to result in a friction fit with channel 420 when the jumper contact o-ring combination is assembled into channel 420. As can be further seen, second metal contacts 130, which appear as pins in this embodiment, are in contact with third metal contacts 230 of the receptacle, so that circuits formed by these contacts are closed.

Figure 5C:
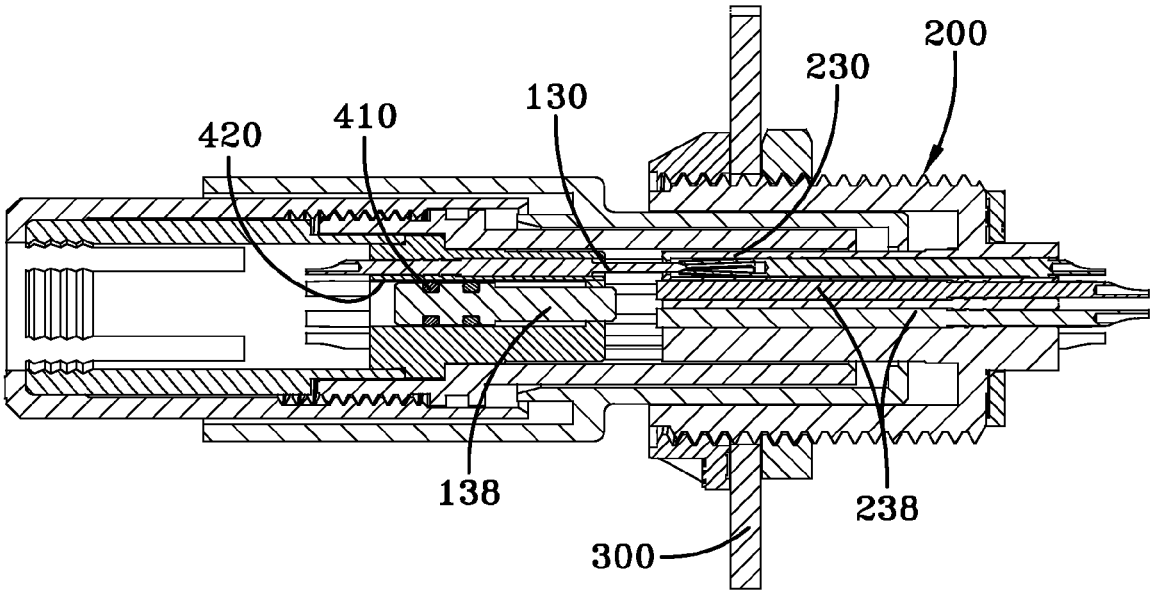
FIG. 5C is a detailed cross sectional view of section A-A of end view of the assembly of the present invention, with plug connector mated to the receptacle and the jumper contact in its second position, the fixed metal contacts retracted from the jumper contact.

FIG. 5C depicts jumper contact 138 locked into its second position, but out of contact with fixed contacts 238. This configuration can occur during remating of plug connector 100 with a receptacle 200, or by slight withdrawal of plug connector 100 with receptacle 200. This withdrawal can be designed into the disassembly, can occur by operation of the individual mating the plug connector. The second metal contacts 130 and third metal contacts 230 remain in contact with one another even though fixed contacts 238 are not in contact with jumper contact 138. Further, jumper contact 138 remains in its second position, held there as a result of friction between o-rings 410 and channel 420. During remating operations of a previously installed plug connector 100, the jumper contact 138 of plug connector 100 will be in its second position, and second metal contacts 130 will contact third metal contacts 230 before jumper contact 138 contacts fixed contacts 238, if jumper contact 138 contacts fixed contacts 238 at all. In this circumstance, the signal that results from the first contact of fixed contacts 238 to jumper contact 138 does not occur first, and depending on the design, may not occur at all. In any event, the lack of the signal or the timing of this signal on remating indicates that the plug connector had been previously installed.

FIGS. 6-9 illustrate a third embodiment of the present invention in which the one of the first parts and the second parts of assembly 10 is assembled to a printed circuit board (PCB). This embodiment provides virtually universal application of plug connector/receptacle assembly 10, as a PCB for virtually any field of use requiring limited use can be designed to accommodate an assembly 10 of the present invention. However, while these Figures depict the invention assembled to a PCB, the Figures further demonstrate that termination can be broadly applied to virtually any electrical application method, as termination is not a limiting feature of the present invention.

Figure 6:
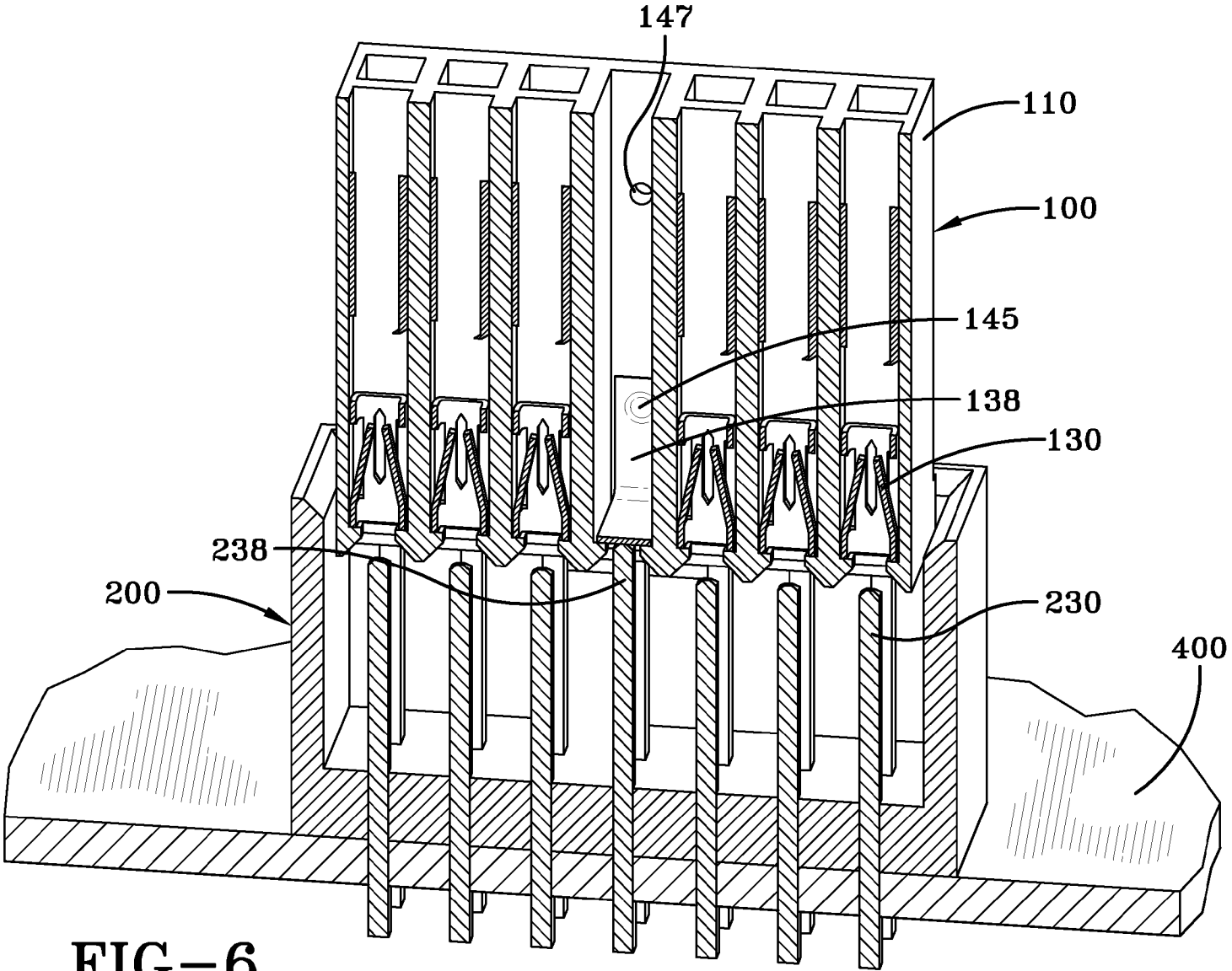
FIG. 6 depicts, in cross-section, an embodiment of the present invention in which the receptacle is attached to a printed circuit board and the plug connector/receptacle of the present invention has a rectangular cross-section and a plurality of rows of contacts, in a partially mated condition.

FIG. 6 depicts, in cross-section, an embodiment of an assembly 10 of the present invention in which the second part 200 is assembled to a PCB 400 and first part 100 is depicted as partially mated to the first part 200. In FIG. 6, first jumper contact 138 is shown in its first position, and fourth fixed contacts 238 are shown abutting and in contact with jumper contact 138, while second metal contacts 130 are out of contact with third metal contacts 230. In this position, when receptacle 200 is connected to equipment through PCB 400 and plug connector 100 is connected to instrumentation, the circuit formed by first jumper contact 138 and fourth fixed contacts 238 is closed, while the circuits formed by the second metal contacts and the third metal contacts are open, resulting in a signal being transmitted indicative of a plug connector that has not previously been mated with a receptacle. Further insertion of plug connector 100 into receptacle 200 will result in first jumper contact 138 being moved from its first position to its second position, while being locked into its second position, and second metal contacts 130 will engage third metal contacts 230, thereby closing these circuits and making instrumentation attached to plug connector 100 operational. As shown in FIGS. 6-9, second metal contacts 130 and mating third metal contacts 230 are arranged in two parallel rows. It should be noted that any configuration may be utilized and the invention is not dependent on the arrangement of the contacts. Also, in contrast to the embodiments depicted in FIGS. 1-5 in this embodiment, the third metal contacts 230 in receptacle 230 are male, while the second metal contacts 130 in plug connector 100 are female. This further illustrates that the invention is not dependent on the configuration of the contacts, but rather that the arrangement of contacts is interchangeable, the arrangement not being an important aspect of the present invention. The only consideration with respect to the second and third contacts is that they be reliably mateable.

The depiction of FIGS. 6-9 illustrates an embodiment having a different termination arrangement for the invention, but demonstrates that operation of the invention is independent of the termination arrangement of the connector. In this arrangement, the PCB can be programmed with software or firmware that tracks single use or limited use of plug connector 100. However, operation and design of the PCB is separate from the novel aspects of the present invention.

Figure 7:
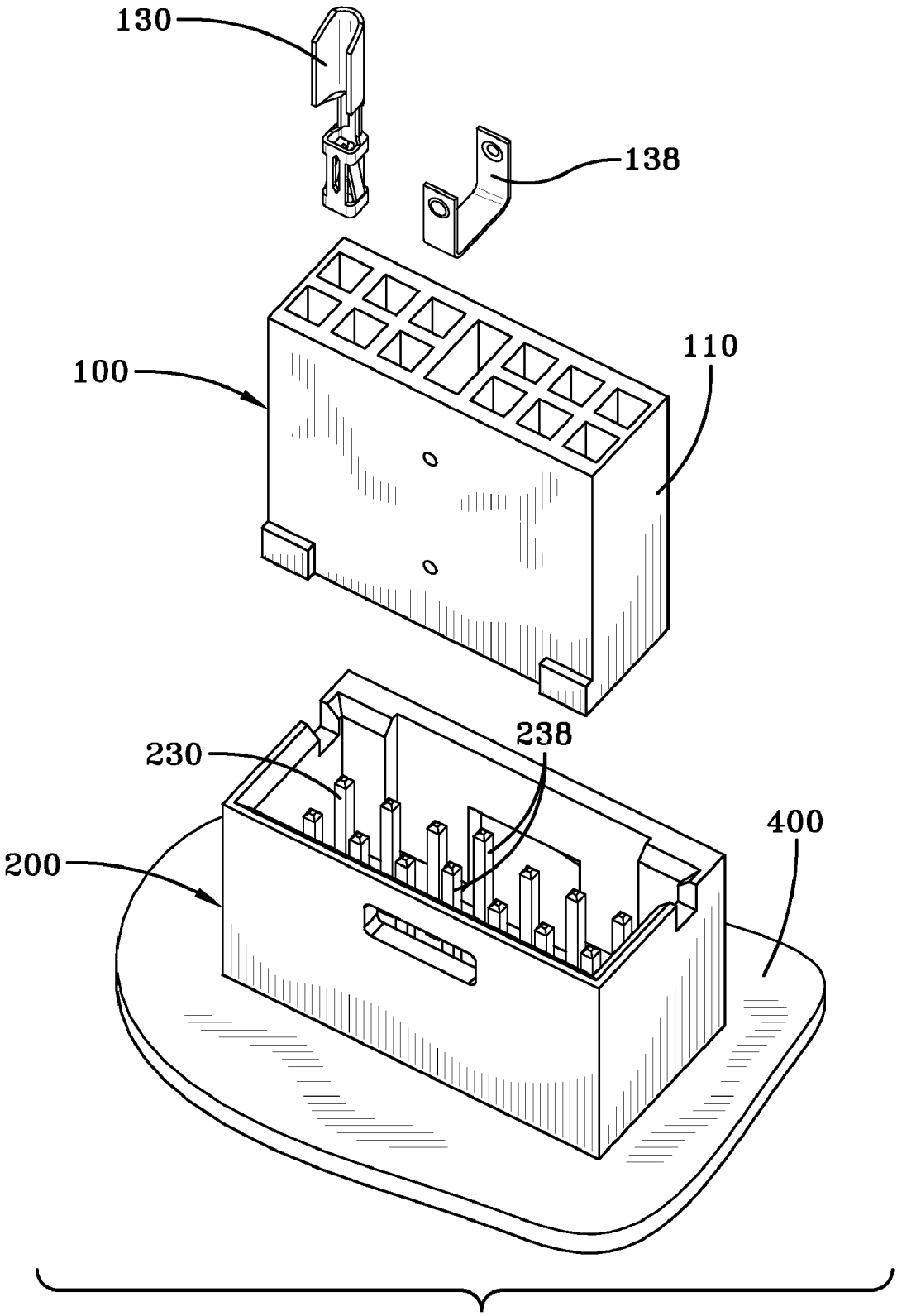
FIG. 7 depicts an exploded view of the plug connector and receptacle of FIG. 6.

FIG. 7 depicts an exploded view of the plug connector/receptacle 10 of FIG. 6. Receptacle 200 is depicted assembled to PCB 400, shown as a cut-away. The third metal contacts 230 and fourth fixed contacts 238 are also shown. Plug connector 100 includes a housing 110 that includes a plurality of apertures. Also shown is a typical second metal contact 130 and first jumper contact 138 that are inserted into the plurality of apertures of housing 110. In this embodiment, first jumper contact 138 is inserted into the central rectangular aperture, while a second metal contact 130 is inserted into each of the remaining square apertures. Once again, the invention is not dependent upon this arrangement, and any other arrangement may be used.

Figure 8:
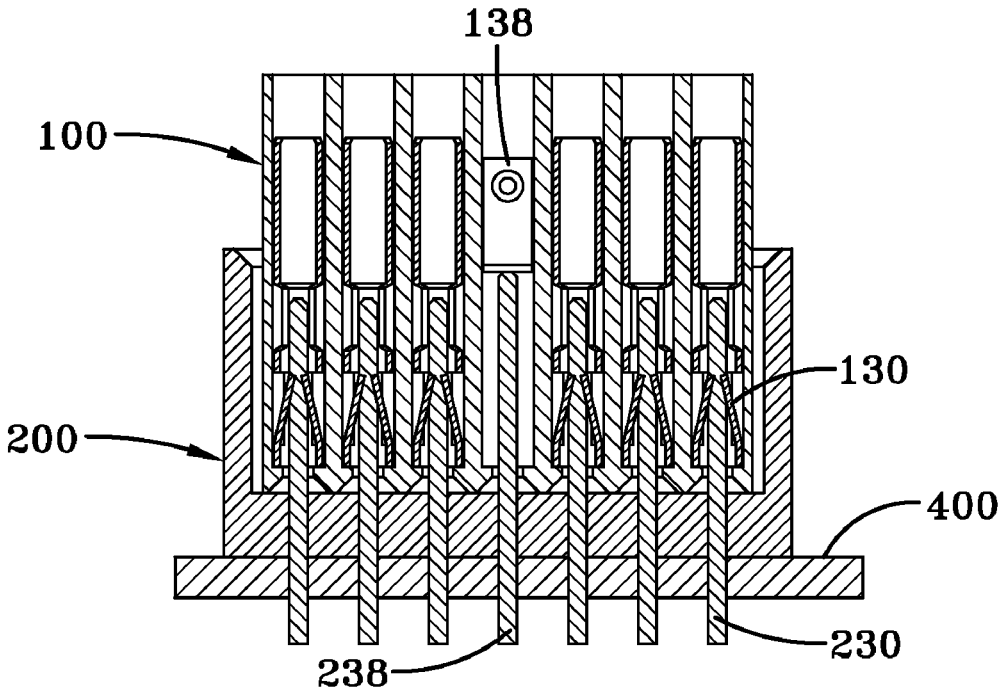
FIG. 8 depicts, along a cross-section A-A, the plug connector/receptacle assembly of FIG. 6 with the plug connector mated to the receptacle with the metal contacts of the plug connector in communication with the metal contacts of the receptacle.

FIG. 8 depicts, along a cross-section A-A, the assembly 10 of FIG. 6, but with plug connector 100 mated to receptacle 200 with second metal contacts 130 in communication with third metal contacts 230. In this embodiment, first jumper contact 138 has been urged by fourth fixed contacts 238 from its first position to its second position, where dimple 145 of first jumper contact 138 engages aperture 147 or recess in the housing of plug connector 100, thereby preventing further movement of first jumper contact 138. First jumper contact 138 is guided by the aperture in the housing of plug connector 138 in which it is free to move from a first position to a second position where it is captured. Second contacts 130 are installed and captured in the square apertures of the housing of plug connector 100. These are locked into position within the apertures on installation and are not free to move.

Figure 9:
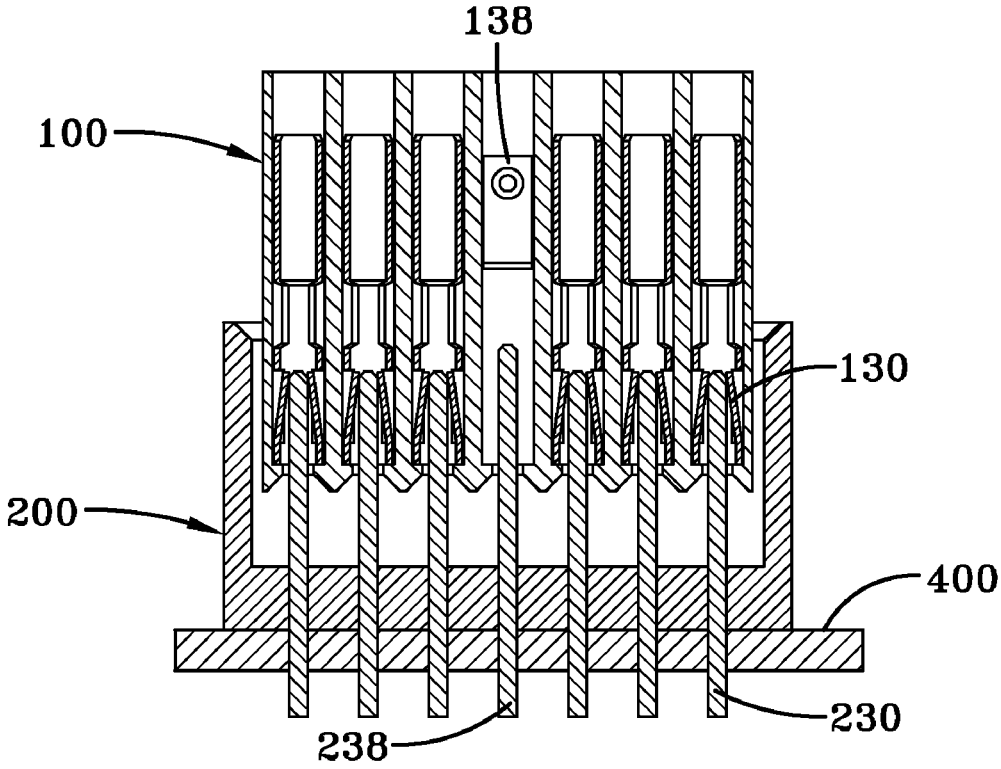
FIG. 9 depicts, along a cross-section A-A, the plug connector/receptacle assembly of FIG. 6 with the plug connector partially unmated from the receptacle and the jumper contact in its second position.

FIG. 9 depicts, along a cross-section A-A, the assembly 10 of FIG. 6 with the plug connector moved away from the receptacle and the first jumper contact captured in its second position. This position can be achieved by slightly withdrawing plug connector 100 from receptacle 200 after fully inserting it to move first jumper contact 138 from its first position to its second position, or it may be achieved on subsequent insertion of plug connector 100 into receptacle 200 to engage second metal contacts 130 to metal contacts 230, as first jumper contact 138 is locked into its second position.

The above examples are exemplary, and the concepts of the present invention are not limited to these examples.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A mechanical device disclosing prior mating, comprising:

a first part, the first part including a first conductive device movable from a first position to a second position, a retention feature that captures the movable conductive device in the second position, and a plurality of second conductive devices;

a second part, the second part including a plurality of third conductive devices mateable with the second conductive devices;

a plurality of fourth substantially inelastic conductive devices, the second part mateable to the first part;

wherein upon initial mating, the fourth substantially inelastic conductive devices of the second part contact the first movable conductive device of the first part to close a circuit prior to the plurality of second conductive devices of the first part contacting the plurality of third conductive devices of the second part; and wherein upon full mating of the first and second parts, the substantially fourth inelastic conductive devices of the second part urge the first movable conductive device of the first part to its second position, at which location it is captured by the retention feature, the second position being such that upon any subsequent mating of the first and second part, the plurality of second conductive devices of the first part contact the plurality of third conductive devices of the second part prior to the first movable conductive device of the first part contacting the fourth substantially inelastic conductive devices of the second part;

wherein the first conductive device is a jumper contact; the plurality of second conductive devices are the plurality of second contacts; the plurality of third conductive devices are the plurality of third contacts.

2. The mechanical device of claim 1 wherein the retention feature includes at the second position a surface having dimensional tolerances that interfere with the jumper contact, thereby capturing the jumper contact in the second position.

3. The mechanical device of claim 1 wherein the second part is a receptacle further including a housing having a first end and a second end, and wherein the plurality of fourth substantially inelastic conductive devices are fixed metal contacts and the third conductive devices are metal contacts located in the housing, the third metal contacts and fixed metal probes positioned in the housing and extending from the first end of the housing.

4. The mechanical device of claim 1 wherein the second part is a receptacle further including a housing having a first end and a second end, and wherein the plurality of fourth substantially inelastic conductive devices are fixed metal contacts and the third conductive devices are metal contacts located in the housing, the metal contacts and fixed metal probes positioned in the housing and extending from the first end of the housing, the fixed metal probes extending a greater distance from the housing than the metal contacts.

5. The mechanical device of claim 1 wherein the second part is a plug connector further including a housing having a first end and a second end, and wherein the plurality of fourth substantially inelastic conductive devices are fixed metal contacts and the third conductive devices are metal contacts located in the housing, the third metal contacts and fourth fixed metal contacts positioned in the housing and extending from the first end of the housing, the fourth fixed metal contacts extending a greater distance from the housing than the third metal contacts and the third metal contacts and the fourth fixed metal probes configured to accept a wire from the second end.

6. The mechanical device of claim 1 wherein the first part is a plug connector comprising the plurality of second conductive devices wherein the plurality of second conductive devices are metal contacts, each contact configured to accept a wire, a housing to locate and align the plurality of second metal contacts, the housing further including an exterior and an interior, and the first movable conductive device wherein the first movable conductive device is a jumper contact movable from a first position to a second position in the housing; and the second part is a receptacle including a housing having a first end and a second end, and wherein the plurality of fourth substantially inelastic conductive devices are fixed metal contacts and the third conductive devices are metal contacts located in the housing and mateable with the second metal contacts, the third metal contacts and fourth fixed metal contacts positioned in the housing and extending from the first end of the housing, the fixed metal contacts extending a greater distance from the housing than the third metal contacts.

7. The mechanical device of claim 1 wherein the first part is receptacle comprising the plurality of second conductive devices wherein the second conductive devices are metal contacts, each metal contact configured to accept a wire, a housing to locate and align the plurality of second metal contacts, the housing further including an exterior and an interior, and the movable first conductive device, wherein the movable first conductive device is a jumper contact movable from a first position to a second position in the housing; and the second part is a plug connector comprising a housing having a first end and a second end, the plurality of fourth substantially inelastic conductive devices wherein the plurality of fourth inelastic conductive devices are fixed metal contacts, the plurality of third conductive devices wherein the third conductive devices are metal contacts located in the housing and mateable to the plurality of second conductive devices, and wherein the third metal contacts and fourth fixed metal contacts positioned in the housing and extending from the first end of the housing, the fourth fixed metal contacts extending a greater distance from the housing than the third metal contacts and the third metal contacts and the fourth fixed metal probes are configured to accept a wire from the second end.

8. The mechanical device of claim 1 further including electronics in communication with one of the first part and the second part, the electronics responding to the closing of the circuit between the fourth inelastic conductive devices of the second part and the first movable conductive device of the first part to disclose a lack of prior mating of the first part and the second part.

9. The mechanical device of claim 1 further including electronics in communication with one of the first part and the second part, the electronics responding to the closing of the circuit of the second conductive devices of the first part by contacting the plurality of third conductive devices of the second part before the closing of the circuit between the fourth inelastic conductive devices of the second part and the first movable conductive device of the first part to disclose prior mating of the first part and the second part.

10. The mechanical device of claim 1 wherein the first part is a plug connector wherein the a plurality of second conductive devices are metal contacts, each contact configured to accept a wire;

the plug connector further including a housing to locate and align the plurality of second metal contacts, the housing further including an exterior and an interior, and wherein the movable first conductive device is a jumper contact movable from a first position to a second position in the housing.

11. The plug connector of claim 10 wherein the retention feature is a depression in the housing at the second position sized to accept the jumper contact when the jumper contact is moved to a second position.

12. The plug connector of claim 10 wherein the retention feature includes a jumper contact having a dimple, and a raised block having a biased nipple that engages the dimple when the jumper contact is moved to the second position, thereby capturing the jumper contact in the second position.

13. The plug connector of claim 10 wherein the retention feature includes a jumper contact having a dimple, and a housing having a recess that engages the dimple when the jumper contact is moved to the second position, thereby capturing the jumper contact in the second position.

14. The plug connector of claim 13 wherein the recess is an aperture in the housing.

15. The mechanical device of claim 1 wherein the first part is a receptacle wherein the plurality of second conductive devices are second metal contacts, each second metal contact configured to accept a wire;

the receptacle further including a housing to locate and align the plurality of second metal contacts, the housing further including an exterior and an interior, and wherein the first movable conductive device is a jumper contact movable from a first position to a second position in the housing.

16. The receptacle of claim 15 wherein the retention feature is a depression in the housing sized to accept the jumper contact when the jumper contact is moved to a second position.

17. The receptacle of claim 15 wherein the retention feature includes a jumper contact having a dimple, and a raised block having a biased nipple that engages the dimple when the jumper contact is moved to the second position, thereby capturing the jumper contact in the second position.

18. The receptacle of claim 15 wherein the retention feature includes a jumper contact having a dimple, and a housing having a recess that engages the dimple when the jumper contact is moved to the second position, thereby capturing the jumper contact in the second position.

19. The receptacle of claim 18 wherein the recess is an aperture in the housing.

* * * * *